US005628341A

United States Patent [19]

Bodden

[11] Patent Number: 5,628,341

[45] Date of Patent: May 13, 1997

[54] MOUNTING ASSEMBLY FOR FLEXIBLE TUBING

[76] Inventor: Roland L. Bodden, 2417 Pointmere Dr., Harvey, La. 70058

[21] Appl. No.: 513,499

[22] Filed: Aug. 10, 1995

[51] Int. Cl.[6] ..... B65H 75/34

[52] U.S. Cl. ..... 137/355.26; 137/355.16; 242/398; 242/407

[58] Field of Search ..... 137/355.26, 355.27, 137/355.16; 242/398, 407

[56] References Cited

U.S. PATENT DOCUMENTS

| | | | |
|---|---|---|---|
| 904,380 | 11/1908 | Vader | 137/355.26 |
| 1,096,232 | 5/1914 | Foster | 242/398 |
| 1,245,491 | 11/1917 | Montgomery | 137/355.26 |
| 1,441,157 | 1/1923 | Krenke | 137/355.26 |
| 2,777,646 | 1/1957 | Manahan | 242/407 |
| 5,205,521 | 4/1993 | Smith | 137/355.27 |

FOREIGN PATENT DOCUMENTS

| | | | |
|---|---|---|---|
| 371130 | 4/1932 | United Kingdom | 242/398 |
| 384787 | 12/1932 | United Kingdom | 137/355.26 |

*Primary Examiner*—A. Michael Chambers
*Attorney, Agent, or Firm*—Keaty & Keaty

[57] ABSTRACT

The invention relates to a mounting assembly for retaining a length of flexible tubing in ready communication with a source of liquid. The assembly provides for the use of a reel portion which retains the flexible tubing and a mounting portion which supports the wheel portion above the ground. The reel portion is rotationally detachably connected to a tubing which, in turn, is fluidly connected to either an underground source or to a conventional municipal water supply.

22 Claims, 2 Drawing Sheets

MOUNTING ASSEMBLY FOR FLEXIBLE TUBING

BACKGROUND OF THE INVENTION

This invention relates to a storage mounted for flexible tubes, such as for example, a garden hose.

It has been a long-standing problem to store elongated flexible tubing in such a manner as to make the tubing easily accessible for connections to a source of liquid while preventing tangling of the tubing. Such tangling often leads to damage of the tubing which is exacerbated by the presence of left-over liquid inside the tubing if the liquid has not been properly drained.

To solve this problem, the industry offers a rigid bracket attachable to a vertical structure, such as a post or a wall. The bracket is mounted at a right angle to the vertical structure allowing the user to wrap the tubing in coils about the bracket and store it in a relatively tangle-free condition. However, wrapping and unwrapping the tubing, or hose from such a bracket is not convenient because the bracket is fixedly mounted to a vertical support, and the user has to work around this limitation.

The present invention contemplates elimination of drawbacks associated with the conventional tubing storage devices and provision of an improved mount for flexible tubing.

SUMMARY OF THE INVENTION

It is, therefore, an object of the present invention to provide an improved mount for flexible tubing.

It is another object of the present invention to provide a mount for flexible tubing which can be used in a variety of conditions depending on accessibility of a liquid source.

It is a further object of the present invention to provide a support for flexible tubing which is easy to connect/disconnect and inexpensive to manufacture.

The above and other objects of the present invention are achieved through a provision of an assembly for mounting flexible tubing a flotation conveniently connected to a source of fluid. The assembly comprises a reel portion on which a discrete length of flexible tubing is retained wrapped in coils. The reel portion is formed by a pair of parallel plates with spacer bars attached to the plate and extending between the facing surfaces of the plates. The flexible tubing is wrapped about the spacer bars while the tubing is in storage. A first liquid conduit extends between plates and outwardly through an opening fitted with a bearing in one of the plates for fluid connection to a parallel second conduit fluidly communicating with the first conduit through a connecting conduit. A support member extends downwardly from the second conduit and allows the liquid to be delivered from a source of fluid to the second conduit, further to the connected conduit and then to the first conduit, from which it is dispensed into the flexible tubing. The support member is detachably rotationally mounted on the second portion of the assembly designed to support the reel portion above the ground.

The present invention provides for a number of embodiments of supporting and the reel portion, with some of the embodiments utilizing upright posts with perpendicularly extending brackets which receive and retain the support member of the reel portion and allow the support member to be connected to conduits delivering liquid to the flexible tubing through the reel portion. Other embodiments utilize an upright hollow body which receives the support member and the connecting conduit for delivering liquid to the flexible tubing from an underground source or from conventional usable water supply.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
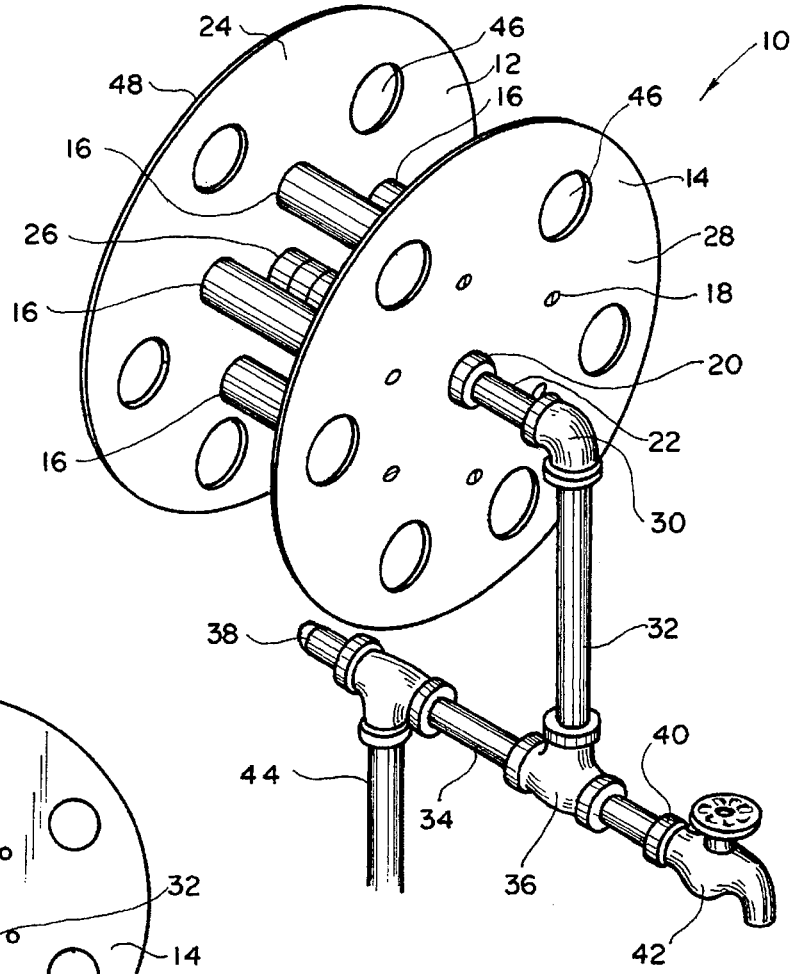
FIG. 1 is a perspective view of a reel portion of the apparatus in accordance with the present invention.

Referring now to the drawings in more detail, numeral 10 designates a reel portion of the apparatus in accordance with the present invention. The reel portion 10 comprises a pair of circular plates 12 and 14 retained in a parallel spaced-apart relationship by a plurality of rigid spacer bars 16. The spacer bars 16 are removably attached in a circular fashion about a center of each of the plates 12 and 14 by bolts 18 or by other suitable means of detachable connection.

A central bearing 20 is fitted in an opening made in the plate 14 to allow passing of a first conduit 22 therethrough. The bearing 20 supports the reel portion 10 in secure position on the first conduit 22. The first conduit 22 extends between the plates 12 and 14 and terminates at the inside surface 24 of the plate 12. A portion of the first conduit 22 which extends between the plates 12 and 14 is provided with a rotating joint 26 and a suitable means 25 (see FIG. 4) for connecting one end of an elongated flexible tubing (not shown). Another portion of the first conduit 22 extends outwardly from an exterior surface 28 of the plate 14 and is connected, by for example an elbow joint 30 to a connecting conduit 32 which is oriented at a right angle to a longitudinal axis of the first conduit 22. The rotating joint 26 allows the reel portion 10 to rotate while the portion of the conduit 22 which extends through the plate 14 remains stationary.

An opposite end of the connecting conduit 32 is secured to a second conduit 35 by a suitable connector, for example a T-connector 36. The second conduit 34 is oriented in a substantially parallel relationship to the first conduit 22 and consequently, at a right angle for the connecting conduit 32. One end 38 of the second conduit 34 is closed and serves as a handle to allow a user to maintain the reel portion 10 toward the direction of travel of the flexible tubing and provide for a more uniform coiling pattern. The opposite end 40 of the second conduit 34 is adapted for engagement with a liquid flow regulating device, for example faucet 42.

Extending downwardly from the second conduit 34 is a reel portion support member 44 which is adapted to deliver liquid to the second conduit 34, connecting conduit 32 and first conduit 22.

If desired, the plates 12 and 14 can be provided with a plurality of apertures 46 a distance from the outer edges 48 and 50, respectively. Provision of apertures 46 allows to reduce the overall weight of the plates 12 and 14.

The plates 12 and 14 are mounted for rotation about central axes of the plates causing the flexible tubing, connected to the first conduit 22, to wrap around the spacer bars 16 in a plurality of coils when the plates 12 and 14 are rotated.

Figure 2:
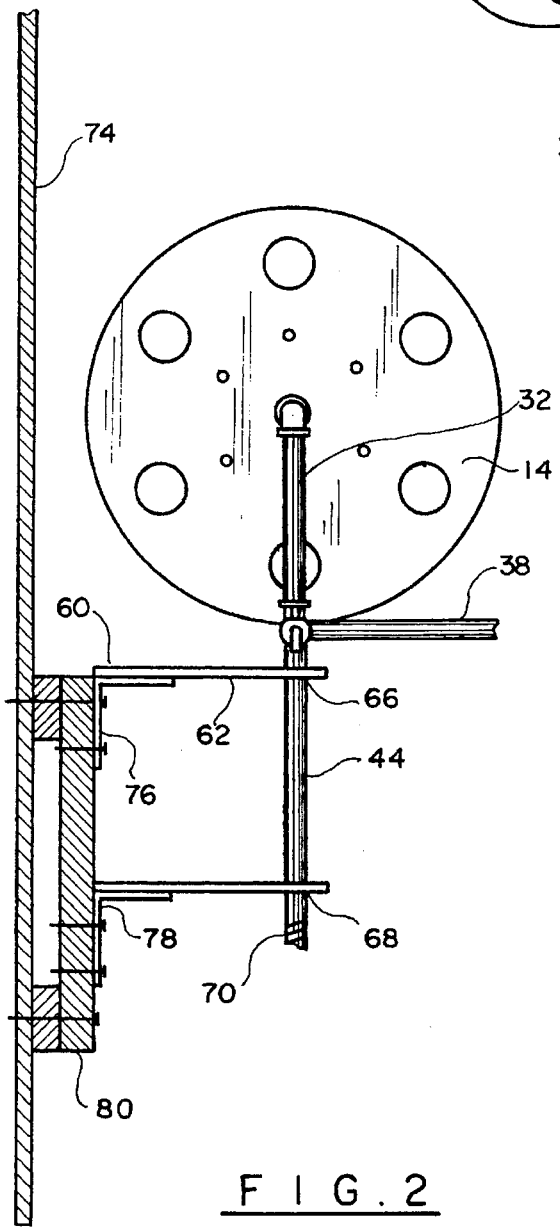
FIG. 2 is a schematic view of a first embodiment of a support for the reel portion suitable for attachment to a vertical structure.

Turning now to FIG. 2, the first embodiment of supporting the reel portion 10 is illustrated. The supporting portion 60 comprises one or more elongated plates engaging the reel portion support member 44. In an exemplary embodiment shown in FIG. 2, an upper attachment plate 62 and a lower attachment plate 64 detachably receives the support member 44 in suitably dimensioned corresponding openings 66 and 68, respectively.

Figure 3:
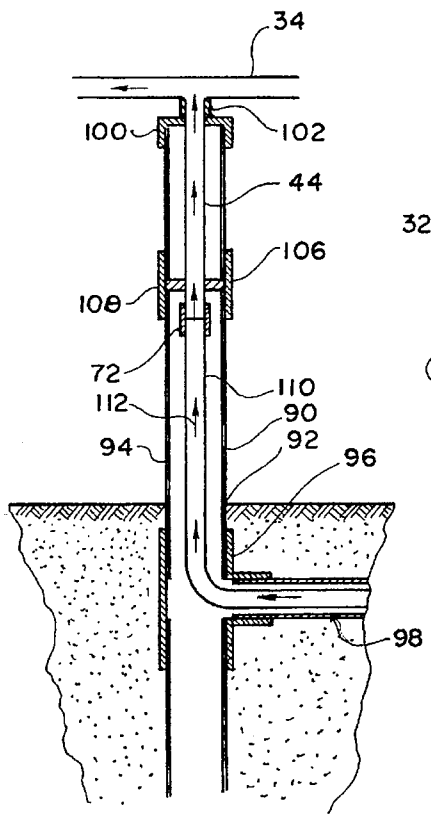
FIG. 3 is a schematic view of a second embodiment of a support for the reel portion suitable for use where a source of water is an underground supply.

The lowermost part of the support member 44 is threaded, as at 70, to allow connection of the support member 44 to a source of liquid flow. It is preferred that a connector allowing 360 degree revolution of the support member 44 about its longitudinal axis be engaged with the lowermost part of the support member to facilitate orientation of the reel portion 10 to a position most convenient for a user. For example, a rotating joint 72, as shown in FIG. 3, can be engaged with the lowermost portion of the supporting member 44. The reel portion 10 can be easily removed from engagement with the supporting portion 60 by disconnecting the joint and moving the reel portion upwardly. This will allow to store the reel portion 10 separately from the supporting portion 60.

As can be further seen in FIG. 2, the supporting portion 60 comprises means for attaching the supporting portions 60 to an independent vertical structure, such as for example fence 74. The attachment means comprises one or more L-shaped brackets 76, 78 securely attached to the attachment plates 62, 64, respectively, and to the vertical structure. If desired, a secondary structure 80 can be used for attaching the brackets to the fence 74. The brackets 76, 78 can be bolted to this secondary structure 80 or secured by other suitable means.

Turning now to FIG. 3, a second embodiment of connecting the reel portion to a water supply is illustrated. In this embodiment the supporting member 44 is received inside an elongated hollow body 90 which extends below the ground at its lower portion 92 and extends, to a discreet distance, above the ground at its upper part 94. The lower part 92 is engaged with a T-connector 96, which in turn is connected to an underground water supply through a conduit 98. To ensure secure portion of the body 90, the lower part 92, along with the connector 96, can be cemented at a level below the ground.

The upper part 94 is provided with a cap 100 at its top. The cap 100 is formed with a central aperture 100 allowing the support member 44 to pass therethrough. A wear washer 104 surrounds the support member 44 when it exits the pipe 90. Another washer 106 is mounted below the washer 102 at a point adjacent engagement of the support member 44 with a rotating joint 72. The washer 106 serves as a guide for the support member 44.

A sleeve 108 is slip fitted over the body 90 to retain the washer 106 in its position inside the body 90. The support member 44 is fluidly connected to the underground water supply through a suitable conduit, for example as hose 110, which is also connected to the rotating joint 72. The direction of water flow is schematically shown by arrows 112 in FIG. 3.

Figure 4:
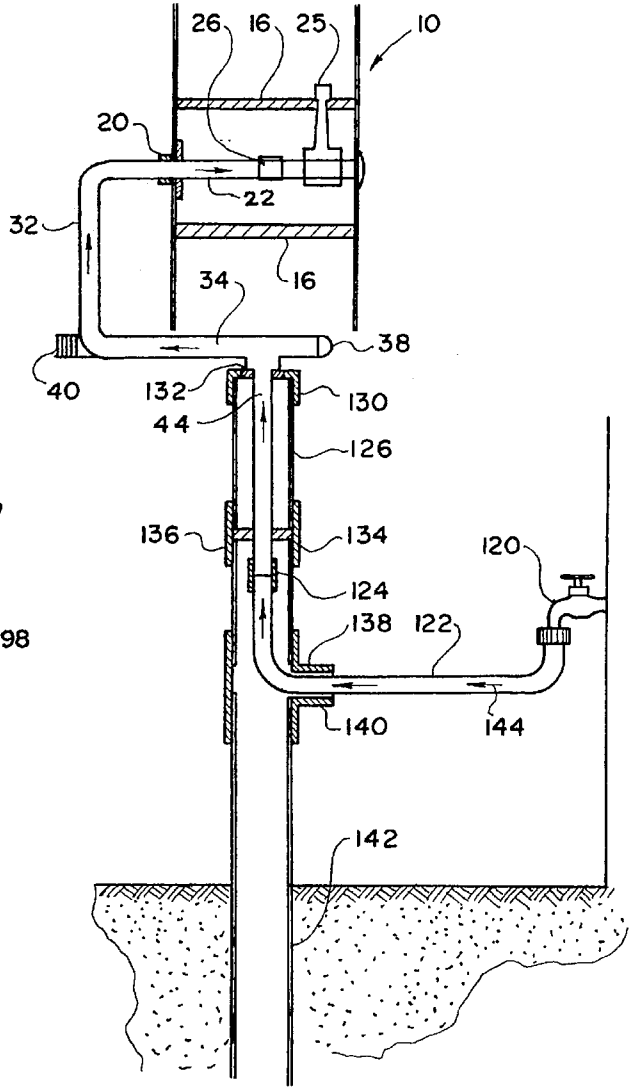
FIG. 4 is a schematic view of a third embodiment of a support for the reel portion particularly adapted for mounting adjacent a water supply such as a faucet.

FIG. 4 illustrates the third embodiment of the manner of supporting the reel assembly 10 in communication with a source of liquid in accordance with this embodiment, the reel assembly 10 can be connected to a regulated valve means, for example, a faucet 120. A tubing, for example a garden hose 122 is secured, in a conventional manner, to the faucet 120 at one of its ends and to the support member 44 at its opposite end.

Similar to the embodiment of FIG. 3, the connection between the tubing 122 and the support member 44 is accomplished similarly to the embodiment of FIG. 3, the support member 44 extends inside an elongated pipe 126 by passing through an opening 128 in a cap 130 and a corresponding alignment opening in a washer 132. The lower part of the support member 44 passes through a guiding washer 134 which is carried by an external sleeve 136. The support member 44 can be disconnected from the hose 122 at its place of connection to the hose by the rotating joint 124.

As can be seen in the drawing, the base 122 enters the pipe 126 through an opening 138 which his sealed off by a T-connector 140. The lower part of the pipe 126 extends below ground and is secured in place by cementing, as at 142.

When the valve in the facet 120 is open, the water flows in the direction of arrows 144, through the hose 122 into the support member 44, then to the second conduit 34, and to the first conduit 22 through a connecting conduit 32. A tubing, such as a garden hose reeled over the reel portion 10 will receive the flow of water from the first conduit 22.

Figure 5:
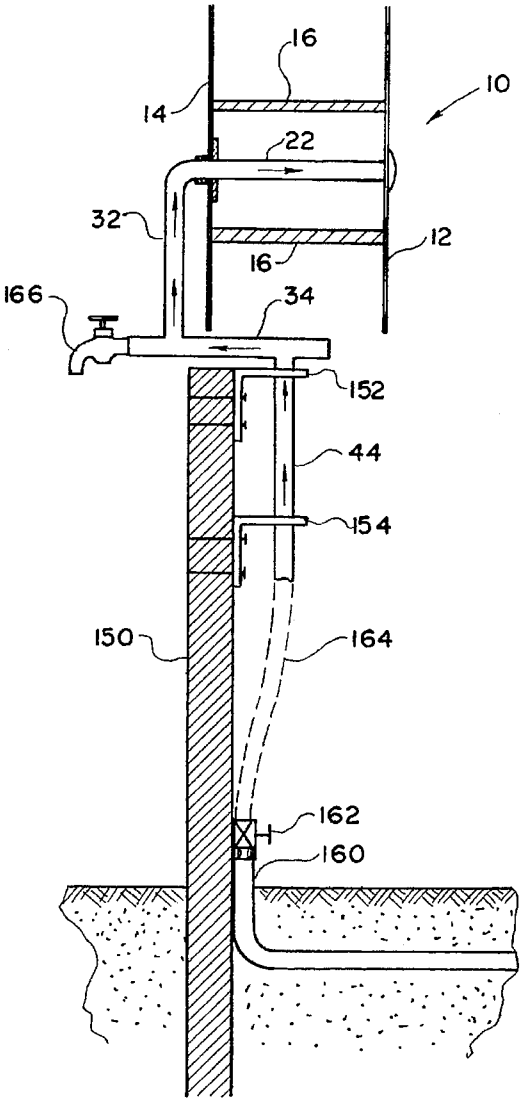
FIG. 5 is a schematic view of a fourth embodiment of a support for the reel portion suitable for mounting to a vertical post.

The fourth embodiment of support means for the reel assembly is shown in FIG. 5. This embodiment allows mounting of the reel assembly adjacent the water supply from municipal services away from such source in fluid communication with an underground water supply. The mounting assembly of this embodiment comprises an upright post 150 carrying one or more L-shaped brackets 152, 154. The vertical portion of each of the brackets is securely attached such as by bolting to the post 150, while the horizontal portion is provided with an opening dimensioned to receive the support member 44 therethrough.

A pipe 160 extends from the below-the-ground location where it receives a fluid flow from an underground source. A regulating valve 162 is provided in the above the ground part of the pipe 160 to allow selective flow of water to the tubing coiled over the reel assembly 10. The support member 44 can be alternatively connected by a suitable conduit (Shown in phantom lines 164 in FIG. 5) to the pipe 160 through the valve 162 or to a standard faucet (not shown). An optional faucet 166 can be attached to the second conduit 34 to allow use of the standard faucet when the tubing supported by the assembly is not in use.

It is one of the advantages of the present invention that the unit can be disassembled and transported on cite in a relatively simple and inexpensive manner. The unit can be packaged in a small container and stored or transported when not in use.

It is envisioned that the conduits forming part of the assembly in accordance with the present invention will be made from a non-corrosive material, such as metal or strong plastics. For example, and without limitation, such materials as galvanized metal or PVC can be satisfactorily employed. A standard garden hose can be utilized for connecting an above-the-ground water supply such as a faucet, with the support member of the reel portion. Wood may also be employed for upright posts retaining the reel portion. Of course, the above examples are note intended to be exhaustive of the types of materials to be used in manufacturing the mounting assembly of the present invention.

Many other changes and modifications can be made in the design of the present invention without departing from the spirit thereof. I, therefore, pray that my rights to the present invention be limited only by the scope of the appended claims.

I claim:

1. A mounting assembly for flexible tubing, comprising:

A reel portion comprising a pair of substantially parallel plates defining a circular space therebetween, said plates being retained in a spaced-apart relationship by a plurality of removable spacer bars adapted for retaining a discreet length of said flexible tubing wrapped about said spacer bars; and means for fluidly connecting said flexible tubing to a source of liquid, comprising a first conduit extending transversely between said plates, a second conduit extending below said plates in a parallel relationship to said first conduit, a connecting member extending transversely between the first conduit and the second conduit along an exterior of one of said plates, and an elongated support member secured to the second conduit below said circular space in parallel relationship to the connecting member, said support member being adapted for detachable rotational connection to a source of fluid.

2. The assembly of claim 1, wherein said first conduit passes through an opening formed in one of said plates and extends outwardly therefrom.

3. The assembly of claim 2, wherein said first conduit is provided with means for detachably connecting said first conduit to said flexible tubing.

4. The assembly of claim 2, wherein said reel portion is rotationally secured with said first conduit, while that portion of the first conduit which extends outwardly from one of said plates is retained in a stationary position when said reel portion is rotated.

5. The assembly of claim 4, further comprising means for retaining said support member at an above-the-ground level.

6. The assembly of claim 5, further comprising means for connecting the support member to an underground liquid supply.

7. The assembly of claim 6, wherein said means for connecting the support member to an underground liquid supply comprises an elongated conduit provided with a means for controlling a liquid flow mounted downstream of said support member.

8. The assembly of claim 5, wherein said means for retaining the support member comprises an elongated hollow body having an upper portion, which extends above the ground and receives at least a part of said support member therein, and a lower portion which extends a distance below the ground.

9. The assembly of claim 8, wherein said lower portion is fluidly connected to an underground water supply and to said support member.

10. The assembly of claim 8, wherein said upper portion is provided with a top cap, said cap having an aperture which is dimensioned to receive said support member therethrough.

11. The assembly of claim 9, wherein said hollow body is provided with means for guiding said support member inside the hollow body.

12. The assembly of claim 11, wherein said means for guiding comprises a transverse washer secured inside hollow body and provided with an opening through which said support member extends.

13. The assembly of claim 8, wherein said upper portion is fluidly connected to a source of liquid and to said support member.

14. The assembly of claim 5, wherein said means for retaining the support member comprises an upright post carrying at least one attachment plate, said plate being provided with an aperture for receiving said support member therethrough.

15. The assembly of claim 14, wherein said at least one attachment plate extends at a right angle outwardly from said upright post.

16. The assembly of claim 14, wherein said at least one attachment plate is supported by an L-shaped bracket secured to said upright post.

17. The assembly of claim 14, wherein said at least one attachment plate has a generally L-shaped cross-section, such that a part of said attachment plate extends at a right angle outwardly from said upright post.

18. The assembly of claim 1, wherein said second conduit is provided with means for controlling dispensing of liquid through said second conduit.

19. A mounting assembly for flexible tubing, comprising:

a reel portion comprising a first plate and a second plate retained in a spaced-apart parallel relationship by a plurality of removable spacer bars adapted for retaining a discrete length of said flexible tubing wrapped about said spacer bars, said first plate and said second plate defining a circular space there between, said assembly further comprising a first conduit extending between said first plate and said second plate, said first conduit passing through an opening formed in said second plate and extending outwardly therefrom, a second conduit extending below said first plate and said second plate in parallel relationship to said first conduit, a connecting member extending transversely between the first conduit and the second conduit along an exterior of said second plate, and an elongated support member secured to the second conduit below said circular space in parallel relationship to the connecting member, said support member being adapted for detachable rotational connection to a source of fluid; and means for fluidly connecting said flexible tubing to a source of liquid, said connecting means comprising a means for controlling a liquid flow mounted downstream of said support member in fluid communication with said support member.

20. The assembly of claim 19, wherein said first conduit is provided with means for detachably connecting said first conduit to said flexible tubing and a means for rotationally securing a part of said first conduit to said reel portion, while that part of the first conduit which extends outwardly from said second plate is retained in a stationary position when the reel portion is rotated.

21. The assembly of claim 19, further comprising means for retaining said support member at an above ground level, said means comprising an upright post carrying at least one attachment plate, said plate being provided with an aperture for receiving said support member therethrough, and wherein said at least one attachment plate extends at a right angle outwardly from said upright post.

22. The assembly of claim 19, further comprising means for retaining said support member at an above the ground level, said retaining means comprising an elongated hollow body having an upper portion which extends above the ground and receives at least a part of said support member therein, and a lower portion which extends a distance below the ground.

* * * * *